United States Patent [19]

Doguchi et al.

[11] 4,163,350

[45] Aug. 7, 1979

[54] CEILING ATTACHMENT APPARATUS

[75] Inventors: Nobushige Doguchi, Toyama; Moriyoshi Hayashi, Kurobe, both of Japan

[73] Assignee: Yoshida Kogyo K.K., Tokyo, Japan

[21] Appl. No.: 858,013

[22] Filed: Dec. 6, 1977

[30] Foreign Application Priority Data

Dec. 7, 1976 [JP] Japan ..... 51-163618 [U]
Dec. 7, 1976 [JP] Japan ..... 51-163620[U]

[51] Int. Cl.[2] ..... E04B 1/62; E04B 5/52

[52] U.S. Cl. ..... 52/403; 52/241; 52/364; 52/483; 52/731; 52/772

[58] Field of Search ..... 52/39, 241, 397, 403, 52/483, 484, 464, 461, 495, 731, 364, 772

[56] References Cited

U.S. PATENT DOCUMENTS

| | | | |
|---|---|---|---|
| 2,280,094 | 4/1942 | Madsen | 52/464 |
| 3,052,330 | 9/1962 | Hammitt et al. | 52/395 X |
| 3,205,630 | 9/1965 | Felix et al. | 52/464 |
| 3,530,633 | 9/1970 | Scott | 52/464 |
| 3,596,425 | 8/1971 | Kodaras | 52/241 X |
| 3,830,029 | 8/1974 | Vance | 52/395 |

FOREIGN PATENT DOCUMENTS

| | | | |
|---|---|---|---|
| 295767 | 4/1969 | Australia | 52/495 |
| 799148 | 11/1968 | Canada | 52/484 |
| 781391 | 2/1935 | France | 52/464 |
| 357181 | 11/1961 | Switzerland | 52/395 |
| 1056897 | 2/1967 | United Kingdom | 52/364 |

*Primary Examiner*—Alfred C. Perham
*Attorney, Agent, or Firm*—Hill, Van Santen, Steadman, Chiara & Simpson

[57] ABSTRACT

A ceiling attachment apparatus comprising a ceiling joist including a molded frame member having a ]-shaped section having an open space in the central portion or a ceiling joist including a molded frame member having a section of a shape resembling a lip groove and another plate-like molded frame member having both the sides engaged with the lip of said molded frame member, said ceiling joist having a screw-inserting groove formed on the lower face of the lower side thereof in the longitudinal direction, a ceiling panel disposed along the lower face of the ceiling joist, a fitting fixture, a part of which is fitted on a groove formed on the side face of the ceiling panel, and a screw inserted through a hole of the fitting fixture and pressed and fixed into said screw-inserting groove of the ceiling joist.

6 Claims, 8 Drawing Figures

CEILING ATTACHMENT APPARATUS

BACKGROUND OF THE INVENTION

The present invention relates to a ceiling attachment apparatus. More particularly, the invention relates to a ceiling attachment apparatus utilizing a ceiling joist consisting of a molded frame member of aluminum having a ]-shaped section.

As the conventional means for attaching a ceiling below a slab with a certain distance therefrom, there can be mentioned a method in which a ceiling base such as a ceiling joist composed of a shape steel is constructed by using bolts hung down from the lower face of the slab and ceiling panels are attached to the lower face of the ceiling base by using fitting fixtures or the like. Today, such as section steels and steel plates or band steels formed in a U or W-shape in section, used for construction materials in general, are utilized to provide a device for attaching the ceiling, and such ceiling joist is attached below the slab with a certain distance therefrom by using special fitting fixtures and ceiling panels are attached to the lower face of the attached ceiling joist. Accordingly, processing of such ceiling joist, assembling and attachment operations or drilling operation for formation of screw holes at field (in situ) become inevitably complicated and the operation efficiency or the productivity in the manufacture of the joists in extremely low.

The present invention has been completed as a result of research works made with a view to eliminating these defects involved in the conventional techniques.

It is therefore a primary object of the present invention to provide a ceiling joist which is suitable for mass production.

Another object of the present invention is to provide a ceiling attachment apparatus in which by utilizing this ceiling joist, ceilings can be attached very easily and assuredly without drilling holes in the ceiling panels for attachment.

Still another object of the present invention is to provide a ceiling attachment apparatus by which a ceiling can be finished in beautiful appearance without having any holes in the ceiling panels and partition walls can be attached to this ceiling very easily.

BRIEF SUMMARY OF THE INVENTION

In accordance with the present invention, the foregoing and other objects can be attained by a ceiling attachment apparatus comprising a ceiling joist consisting of a molded frame member of aluminum having a ]-shaped section or ⊓-shaped section (the section having a shape resembling a lip groove), said molded frame member being attached to the lower face of slab or the like, wherein a screw is inserted or screwed into a groove formed in the longitudinal direction on the lower face of the molded frame member having a ]-shaped section or on a plate inserted in the molded frame member having a ⊓-shaped section, thereby to fix a fitting fixture and said fitting fixture is inserted in a groove formed on the side face of a ceiling panel.

DETAILED DESCRIPTION OF THE PREFERRED EMBODIMENTS

The ceiling joist constituting the main part of the ceiling attachment apparatus of the present invention is characterized in that it consists of a frame member having a ]-shaped section or a section having a shape resembling a lip groove, which is formed by extrusion molding of aluminum, this molded frame member can be formed very easily even if it has a special profile and a groove for a screw for fixing a ceiling supporting fitting fixture is continuously formed on this molded frame member.

Another characteristic feature of the ceiling attachment apparatus of the present invention is that a groove is formed on the side face of a ceiling panel and the end portion of the fitting fixture is inserted in this groove and it is dismountably attached to the lower face of the ceiling joist very easily by utilizing a screw.

Figure 1:
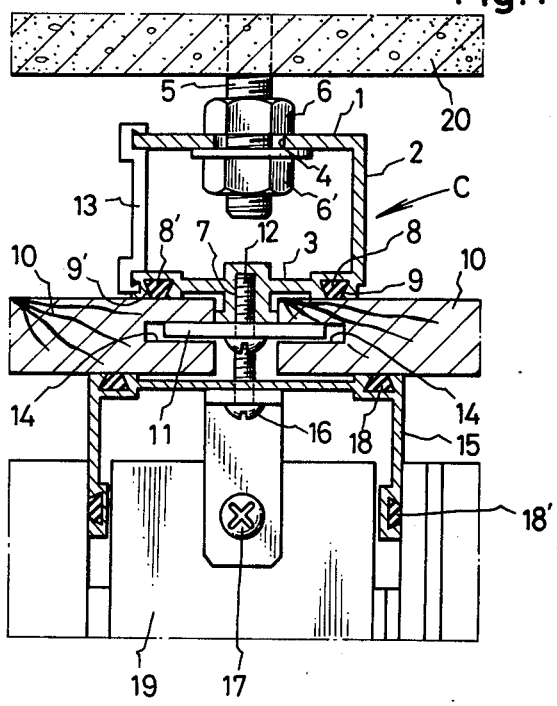
FIG. 1 is a view showing the cross section of the main portion of a first embodiment of the ceiling attachment apparatus of the present invention in the state where it is assembled.
Figure 2:
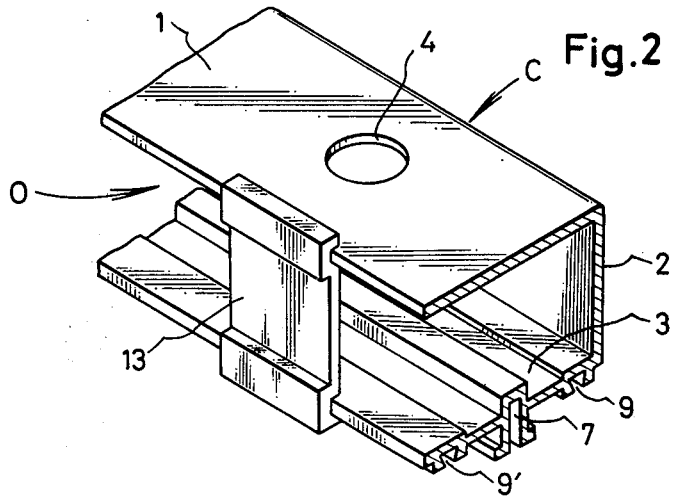
FIG. 2 is a perspective view showing a ]-shaped ceiling joist consisting of a molded frame member of aluminum.

Referring to FIGS. 1 and 2, a ceiling joist C includes an upper side 1, a longitudinal side 2 and a lower side 3 and it is molded to have a ]-shaped section (groove-like section), and holes 4 are formed on the upper side 1 at certain intervals. These holes 4 are formed for insertion of bolts 5 for attaching the ceiling joist C to the lower end of a slab or other ceiling joist attachment member. The vertical position of the ceiling joist C is determined by positions of nuts 6 and 6′ screws to the bolts 5.

A screw-inserting groove 7 is formed in the central portion of the lower side 3 of the ceiling joist C in the longitudinal direction thereof, and dovetail grooves 9 and 9′ are formed on the screw-inserting groove 7 so that air-tight members 8 and 8′ can be inserted therein.

It is indispensable that this screw-inserting groove 7 should have a width sufficient to press and fix into this groove 7 a screw 12 for fixing a fitting fixture 11 for supporting a ceiling panel 10. When the screw 12 is driven in the screw-inserting groove 7, screw threads are formed on both sides of the groove 7 and the screw 12 is fixed. As is seen from FIG. 2, the ceiling joist C is arranged so that the open portion O thereof is disposed in the lateral direction and the upper side is hung down by bolts 5. Accordingly, there is a risk of expansion of open portion O by the weight of the ceiling panel 10 or the like. However, in order to ensure prevention of expansion of the open portion O, it is preferred that a holding plate 13 be fitted and fixed between the upper and lower sides 1 and 3.

A groove 14 is formed on the side face of the ceiling panel 10 so that a strip-like fitting fixture 11 is fixed therein.

At the time of assembling the ceiling attachment apparatus of the present invention in situ, bolts 5 are hung down from a slab 20 and the lower ends thereof are inserted into the holes 4 formed on the upper side 1 of ceiling joist C, and the position of the ceiling joist C is set by utilizing nuts 6 and 6'. Before or after this positioning operation, holding plates 13 are fitted at predetermined intervals between the upper side 1 and lower side 3 of the ceiling joist C.

As shown in FIG. 1, the ceiling panels 10 are disposed along the lower face of the ceiling joist C, and by rotating by 90° the strip-like fitting fixture 11 inserted through the space between the ceiling panels 10 and 10', a part of the fitting fixture 11 is fitted in the groove 14 formed on the side face of the ceiling panel 10 and the fitting fixture 11 is fixed by the screw 12. The screw 12 is pressed into the screw-inserting groove 7 having a width smaller than the outer diameter of the screw 12 and screwed into said groove 7 while forming screw threads on both the sides of the screw-inserting groove 7.

In the embodiment illustrated in FIG. 1, partition walls are disposed in addition to ceiling plates 10. A screw 16 is inserted into a hole of a liner 15, and the top end of the screw 16 is pressed and fixed into the above-mentioned screw-inserting groove 7. FIG. 1 is drawn as if the press-fitting position of the screw 16 were overlapped on that of the screw 12, but practically, the fitting position of the screw 16 is deviated from that of the screw 12 in the longitudinal direction of the screw-inserting groove 7.

After the liner 15 is attached to the lower portion of the ceiling joist C in the above-mentioned manner, the partition wall 19 is fixed to this liner 15 by a screw 17. Air-tight members 18 and 18' may be disposed on this liner 15 according to need. Such air-tight member is composed of a material customarily used in this field, for example, a rubber, synthetic resin or felt.

Figure 3:
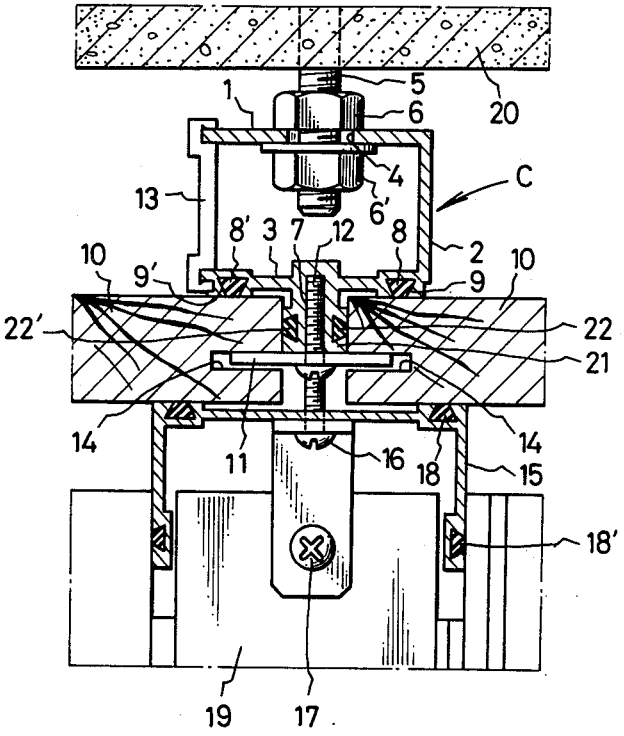
FIG. 3 is a view showing the cross section of a second embodiment of the ceiling attachment apparatus of the present invention in the state where it is assembled.

Referring to FIG. 3 illustrating a second embodiment of the present invention, a projecting wall 21 is formed at the center of the lower side 3 of the ceiling joist C, and air-tight members 22 and 22' are disposed on both the sides of the projecting wall 21 so that air tightness can be kept between the projection wall 21 and each ceiling panel 10.

A third embodiment of the present invention will now be described by reference of FIGS. 4 to 6.

A ceiling joist $C_1$ consists of a molded frame member 25 having a ⊓ -shaped section (lip groove-like section) and a plate-like molded frame 26. Both the frame members 25 and 26 are formed by extrusion molding of aluminum.

The molded frame member 25 includes a top plate 27 and side plates 28 and 28' hung down from both the sides of the top plate 27. Inwardly projecting supporting portions 29 and 29' are formed on the lower portions of these side plates 28 and 28', respectively. Dovetail grooves 30 and 30' are formed on the respective supporting portion 29 and 29' and air-tight members 31 and 31' are filled in the dovetail grooves 30 and 30', respectively.

Holes 32 are formed at predetermined intervals on the upper portion of the molded frame 25, and bolts 5 planted on a slab 20 or the like are inserted and fixed in these holes 32.

Figure 5:
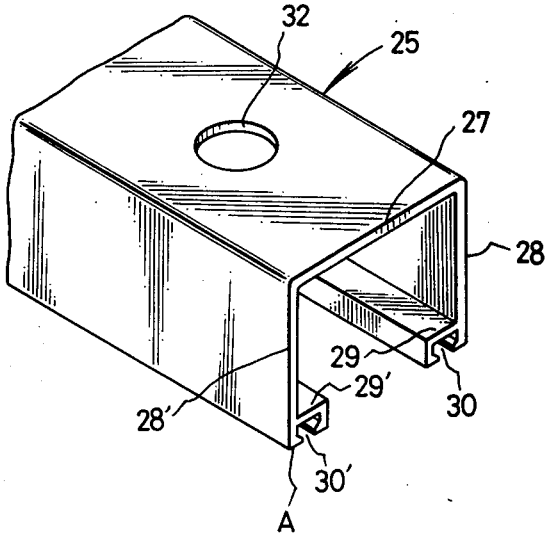
FIG. 5 is a perspective view showing a molded frame member having a -shaped section, namely a section having a shape resembling a lip groove.
Figure 6:
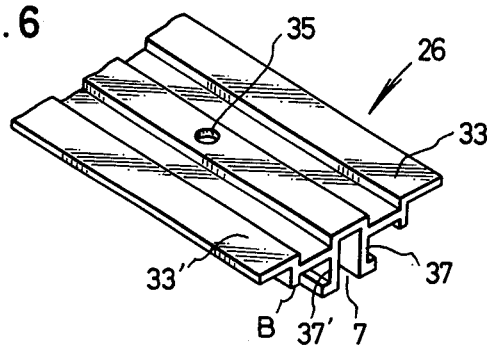
FIG. 6 is a perspective view showing a plate-like grooved frame member to be inserted in the interior of the molded frame member shown in FIG. 5.

The molded frame 26 to be inserted into the molded frame 25 has a platelike shape as shown in FIG. 6. In the lower portion of the center of the plate-like molded frame member 26, a screw-inserting groove 7 is formed along the longitudinal direction thereof between projecting walls 37 and 37', and supporting portins 33 and 33' falling in contact with the supporting portions 29 and 29' are formed on both the sides of the screw-inserting groove 7. The lower parts of the supporting portions 33 and 33' are molded to have an angle-like shape, so that the strength is improved and these supporting portions 33 and 33' are tightly fitted in and engaged with the above-mentioned supporting portions 29 and 29', respectively. Dimensions of these supporting portions 29 and 29' and 33 and 33' are set so that when the molded frame members 25 and 26 are combined, the lower ends A of the supporting portions 29 and 29' (see FIG. 5) and the lower ends B of the supporting portions 33 and 33' (see FIG. 6) are located on the same plane.

At the assembling operation, the bolt 5 hung down from the slab 20 is inserted into the hole 32 formed on the top plate 27 of the molded frame member 25 and they are fixed by nuts 6 and 6'. Then, the molded frame member 26 is inserted into the molded frame member 25, and a screw 34 is inserted into the screw-inserting groove 7 and a part of the screw 34 is projected upwardly through a hole 35 formed in the upper portion of the screw-inserting groove 7. When the top end of the screw 34 arrives at the back face of the top plate 27 of the molded frame member 25, by the repulsive force of the top plate 27 the molded frame member 26 is pressed downwardly and the supporting portions 33 and 33' of the molded frame member 26 are pressed to the supporting portions 29 and 29' of the molded frame member 25. Then, ceiling panels 10 are disposed along the lower face of the so assembled ceiling joist $C_1$, and the top ends of the fitting fixture 11 are inserted in the grooves 14 formed on the side faces of the panels 10. A screw 36 is inserted into a hole of the fitting fixture 11 and this screw 36 is pressed in the screw-inserting groove 7 of the molded frame member 26, whereby the ceiling panels 10 are attached to the lower face of the ceiling joist $C_1$.

Figure 7:
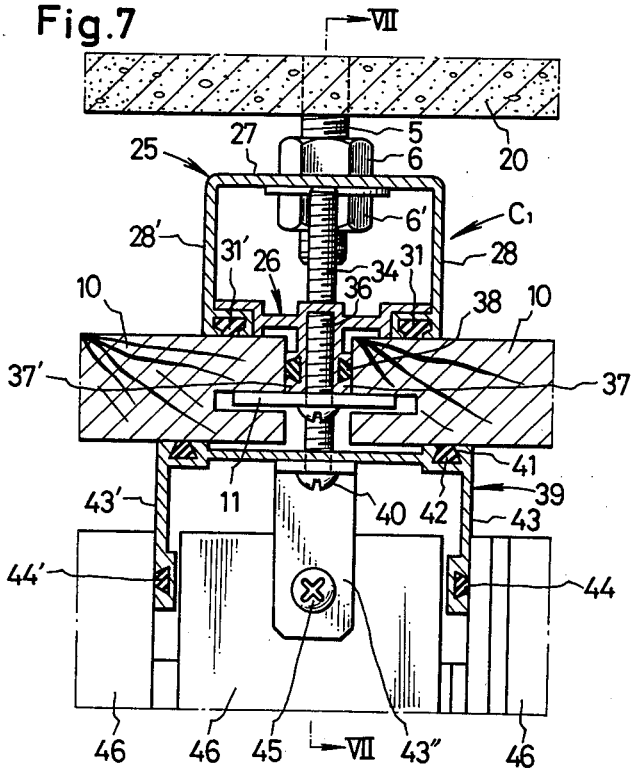
FIG. 7 is a view showing the cross section of the main portion of a fourth embodiment of the ceiling attachment apparatus of the present invention in the state where it is assembled so that upper portions of partition walls are supported.
Figure 8:
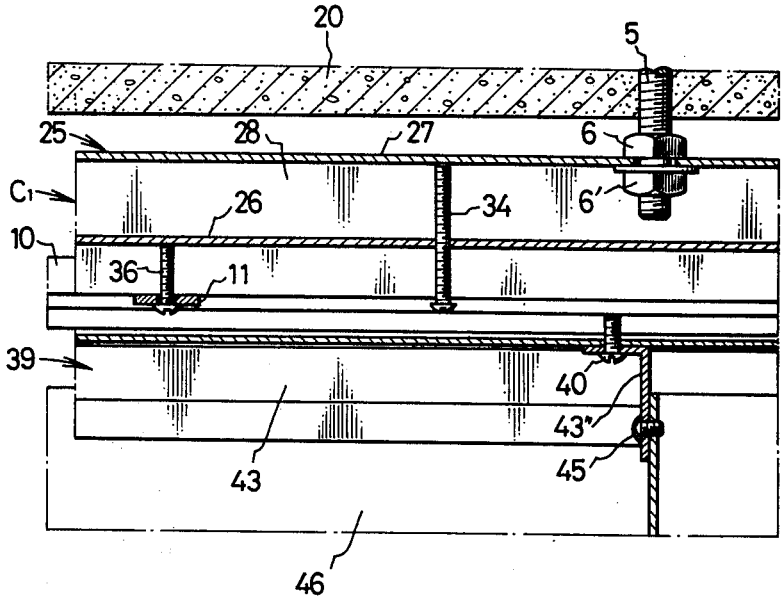
FIG. 8 is a view showing the section taken along the line VII—VII in FIG. 7.

FIGS. 7 and 8 illustrate a fourth embodiment of the present invention in which partition walls are disposed.

A projecting wall 37 is extended from the central portion of a molded frame member 26 having a screw-inserting groove 7 formed thereon and an air-tight member is disposed on the side face of the projecting wall 37. As in the embodiment shown in FIG. 4, the ceiling attachment apparatus is assembled, and then, a molded frame member 39 is fixed to the lower portion of the molded frame member 26 by means of a screw 40 so that the top face of the molded frame member 39 is closely contacted with the lower face of a ceiling panel 10. A groove 41 is formed on the top face of the molded frame member 39 and an air-tight member 42 is fitted in this groove 41. Further, air-tight members 44 and 44' are disposed on side plates 43 and 43' of the molded frame member 39, respectively. The top end of a partition wall 46 is supported by a screw 45 by utilizing holes formed on the side plates 43 and 43' and another side plate 43'' formed integrally with or separately from the molded frame member 39. Thus, assembling of the ceiling attachment apparatus and supporting of the top end of the partition wall have been completed.

Figure 4:
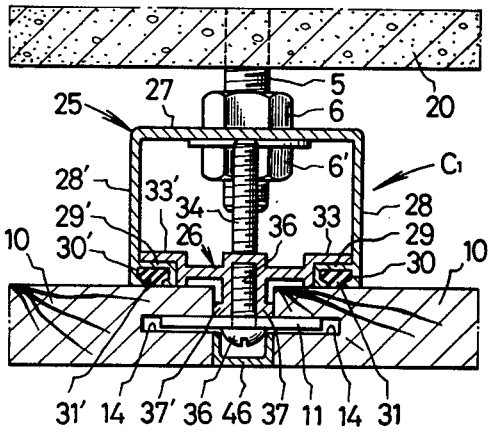
FIG. 4 is a view showing the cross section of a third embodiment of the ceiling attachment apparatus of the present invention.

As shown in FIG. 4, the screw-inserting groove 7 is formed on the molded frame member 6, and further, the projecting walls 37 and 37′ are formed on this molded frame member 26 so that a sufficient strength is imparted to not only the molded frame member 26 but also the entire ceiling joist $C_1$. However, since these projecting walls 37 and 37′ fall in contact with the side faces of the ceiling panels 10, there are formed groove-like clearances in the portions where the projecting walls are present. In this case, if joint fillers 46 are fitted in these clearances, a structure having a good appearance can be obtained.

As will be apparent from the foregoing embodiments, in the present invention, since a frame member constituting the ceiling joist is formed by extrusion molding of aluminum, even a ceiling joist having a peculiar and complicted sectional shape can easily be manufactured at a low cost.

In the embodiments illustrated in FIGS. 1 to 3, since the molded frame member constituting the ceiling joist C has a ]-shaped section and an open portion 0 is formed in the lateral direction, attachment of this ceiling joist C by means of bolts 5 can be remarkably facilitated.

Moreover, since the holding plate 13 is disposed in this open portion 0, deformation of the open portion 0 of the ceiling joist C can be completely prevented.

Still further, since two projecting walls 21 (37 and 37′ in FIG. 7) are formed in the central portion of the lower plate 3 of the ceiling joist C and the screw-inserting groove 7 is formed between these projecting walls, the strength of not only the lower plate 3 but also the entire ceiling joist C can be remarkably improved. Still in addition, since the screw-inserting groove 7 is formed in the longitudinal direction of the ceiling joist C and the ceiling panel 10 can be supported by pressing a screw into this groove 7, the fitting fixture 11 to be fitted in the groove 14 formed on the side face of the ceiling panel can be fixed at an optional position.

In the embodiments shown in FIGS. 1 to 3, grooves 9 and 9′ for attachment for air-tight members may be formed on the lower face of the lower plate 3 of the ceiling joist C, and by attaching air-tight members 8 and 8′ into these grooves, good air tightness can be maintained between the ceiling joist C and the ceiling panels 10. Furthermore, since the side portion of the ceiling joist C is open, the height of the ceiling joist C can easily be adjusted.

In the embodiments illustrated in FIGS. 4 to 8, the ceiling joist $C_1$ consists of two molded frame members 25 and 26, and at first, the upper molded frame member 25 having a section having a shape resembling a lip groove can be fixed to the supporting portion, for example, the lower face of the slab 20 by means of bolts and nuts. After fixing the lip groove-like molded frame member 25 to the slab 20, the plate-like molded frame member 26 is inserted into this molded frame member 25 and the ceiling panel 10 is fixed through the screw and fitting fixture 11 by utilizing the screw-inserting groove 7 formed on the molded frame member 26. Accordingly, the ceiling panel 10 can be attached and fixed very easily.

Since the screw-inserting groove 7 is formed in the longitudinal direction of the ceiling joist C or $C_1$ of the present invention, a liner 15 or molded frame 39 for attachment of a partition wall can be fixed very easily by utilizing this screw-inserting groove 7.

What is claimed is:

1. A ceiling attachment apparatus comprising a horizontal ceiling joist consisting of a molded frame member having a screw-inserting groove formed on the lower side thereof extending in the longitudinal direction, means adjustably rigidly fixing said joist to the ceiling, a screw to be inserted into said screw-inserting groove, at least one ceiling panel having a horizontally extending groove formed in the side edge thereof and an attaching plate inserted in said groove of the ceiling panel, said ceiling panel being disposed along the lower face of said ceiling joist, and screw means tightly securing said attaching plate against said ceiling panel and the panel thereby against the joist and in fixed relation to the ceiling.

2. A ceiling attachment apparatus as recited in claim 1, wherein said ceiling joist comprises a molded frame member substantially ]-shaped in cross section and holding plates extending over both upper and lower sides of said molded frame member, said holding plates being mutually spaced a prescribed distance.

3. A ceiling attachment apparatus as recited in claim 1, wherein said ceiling joist includes a molded frame member having a shape in cross section resembling a lip groove and another molded frame member with its sides supported by the lips of the first mentioned molded frame member and having the said screw-inserting groove formed on the lower side thereof in the longitudinal direction.

4. A ceiling attachment apparatus as recited in claim 1, wherein an air-tight seal member is attached to the lower side of said ceiling joist so that said air-tight seal member is interposed between said lower side and said ceiling panel.

5. A ceiling attachment apparatus as recited in claim 2, wherein a screw for supporting a partition wall is pressed into said screw-inserting groove formed on the lower side of said ceiling joist.

6. A ceiling attachment apparatus as recited in claim 3, wherein a screw for supporting a partition wall is pressed into said screw-inserting groove formed on the lower side of said ceiling joist.

* * * * *